US009695664B2

(12) United States Patent
Rodela et al.

(10) Patent No.: US 9,695,664 B2
(45) Date of Patent: Jul. 4, 2017

(54) HIGH PRESSURE PROPPANT BLENDING SYSTEM FOR A COMPRESSED GAS FRACTURING SYSTEM

(71) Applicant: BAKER HUGHES INCORPORATED, Houston, TX (US)

(72) Inventors: Andres Rodela, Houston, TX (US); Blake Burnette, Tomball, TX (US); D. V. Satyanarayana Gupta, The Woodlands, TX (US); William McCarty, Spring, TX (US); Gaurav Agrawal, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 248 days.

(21) Appl. No.: 14/570,048

(22) Filed: Dec. 15, 2014

(65) Prior Publication Data

US 2016/0168941 A1 Jun. 16, 2016

(51) Int. Cl.

| | |
|---|---|
| ***E21B 33/06*** | (2006.01) |
| ***E21B 43/26*** | (2006.01) |
| ***E21B 33/068*** | (2006.01) |
| ***E21B 43/267*** | (2006.01) |

(52) U.S. Cl.

CPC ..... *E21B 33/068* (2013.01); *E21B 43/267* (2013.01)

(58) Field of Classification Search

CPC ..... E21B 43/267; E21B 43/26

See application file for complete search history.

(56) References Cited

U.S. PATENT DOCUMENTS

| | | | | |
|---|---|---|---|---|
| 3,432,151 | A * | 3/1969 | O'Loughlin | E21B 21/062 366/6 |
| 3,842,910 | A * | 10/1974 | Zingg | E21B 43/26 166/308.1 |
| 4,374,545 | A | 2/1983 | Bullen et al. | |
| 5,515,920 | A * | 5/1996 | Luk | E21B 43/267 166/177.5 |
| 5,558,160 | A * | 9/1996 | Tudor | C09K 8/62 166/177.5 |
| 5,799,734 | A * | 9/1998 | Norman | C09K 8/62 166/177.5 |
| 8,276,659 | B2 | 10/2012 | Fordyce et al. | |
| 8,408,289 | B2 | 4/2013 | Loree | |
| 8,689,876 | B2 | 4/2014 | Loree et al. | |

(Continued)

FOREIGN PATENT DOCUMENTS

| | | | | |
|---|---|---|---|---|
| CA | 2903694 | A1 * | 6/2016 | E21B 33/068 |

OTHER PUBLICATIONS

PID Controller, undated, https://en.wikipedia.org/wiki/PID_controller, pp. 1-15.*

*Primary Examiner* — Jennifer H Gay

(74) *Attorney, Agent, or Firm* — Parsons Behle & Latimer

(57) ABSTRACT

A system for high pressure proppant blending includes at least one high pressure pump coupled to a high pressure flow path, the high pressure flow path entering a wellhead. The system further includes a chamber storing a mixture of proppant and compressed gas. The system also includes a high pressure nozzle. An output of the high pressure nozzle is coupled to the high pressure flow path between the at least one high pressure pump and the wellhead. The chamber is coupled to an input of the high pressure nozzle.

28 Claims, 3 Drawing Sheets

(56) References Cited

U.S. PATENT DOCUMENTS

| | | | | |
|---|---|---|---|---|
| 9,133,700 | B2 * | 9/2015 | Lissianski | E21B 43/267 |
| 9,316,098 | B2 * | 4/2016 | Vandor | E21B 43/267 |
| 2007/0204991 | A1 * | 9/2007 | Loree | C09K 8/64 166/280.1 |
| 2009/0301725 | A1 * | 12/2009 | Case | E21B 43/267 166/308.1 |
| 2010/0044049 | A1 * | 2/2010 | Leshchyshyn | C09K 8/68 166/308.1 |
| 2010/0132949 | A1 * | 6/2010 | DeFosse | B01F 3/1221 166/308.1 |
| 2012/0118566 | A1 * | 5/2012 | Vandor | C09K 8/62 166/280.1 |
| 2013/0168086 | A1 * | 7/2013 | Roberts | E21B 43/267 166/250.01 |
| 2013/0220605 | A1 * | 8/2013 | Vandor | E21B 43/267 166/267 |
| 2014/0000899 | A1 * | 1/2014 | Nevison | E21B 43/26 166/308.1 |
| 2014/0124208 | A1 | 5/2014 | Loree et al. | |
| 2014/0151049 | A1 * | 6/2014 | Sanborn | E21B 21/062 166/305.1 |
| 2014/0174747 | A1 * | 6/2014 | Kelly | E21B 43/267 166/308.2 |
| 2014/0246199 | A1 | 9/2014 | Gupta et al. | |
| 2014/0299321 | A1 * | 10/2014 | Burnette | E21B 43/267 166/293 |
| 2015/0167441 | A1 * | 6/2015 | Howell | E21B 41/00 166/280.1 |
| 2015/0204166 | A1 * | 7/2015 | Sanborn | E21B 21/062 166/244.1 |

* cited by examiner

HIGH PRESSURE PROPPANT BLENDING SYSTEM FOR A COMPRESSED GAS FRACTURING SYSTEM

FIELD OF THE DISCLOSURE

The present disclosure is generally related to compressed gas fracturing systems and more particularly to a high pressure proppant blending system for a compressed gas fracturing system.

BACKGROUND

Compressed gas fracturing processes, such as liquid carbon dioxide (CO2) fracturing, may use pressurized liquefied gases, such as liquid CO2, in conjunction with other substances to open formations within a well bore, thereby facilitating the extractions of mined materials (e.g., oil, natural gas, etc.). As pressure at the well bore is diminished, the formations may close up unless propped open. Some fracturing processes use bulk proppant mixed with the compressed gas. The proppant may include solid granules such as sand, ceramics, and/or sintered bauxite that become lodged within the formation, thereby propping it open as the pressure within the formation decreases.

Fracturing processes that use a mixture of bulk proppant and compressed gas may be described further in U.S. Pat. No. 4,374,545 filed on Jan. 7, 1982 and entitled "Carbon Dioxide Fracturing Process and Apparatus," U.S. Pat. No. 8,689,876 filed on Feb. 20, 2013 and entitled "Liquified Petroleum Gas Fracturing System," U.S. Pat. No. 8,408,289 filed on Mar. 2, 2007 and entitled "Liquified Petroleum Gas Fracturing System," U.S. Pat. No. 8,276,659 filed on Dec. 29, 2008 and entitled "Proppant Addition System and Method," U.S. Patent Application Publication No. 2014/0124208 filed on Jan. 10, 2014 and entitled "Liquified Petroleum Gas Fracturing System," and U.S. Patent Application Publication No. 2014/0246199 filed on Feb. 21, 2014 and entitled "Method of Fracturing with Liquefied Natural Gas," the contents of each of which are incorporated herein by reference in their entirety.

The solid granules of the bulk proppant may be very erosive when moving or flowing against a surface. For example, machinery such as pumps and valves in contact with the bulk proppant as it flows through a fracturing system may be subjected to significant wear. To illustrate, high pressure pumps used to pump the mixture of proppant and compressed gas into the well bore may be subjected to significant wear as they pressurize and move the mixture through the fracturing system. The additional wear may cause additional expense associated with frequent servicing efforts and/or significant limitations on the usable life span of the high pressure pumps.

SUMMARY

Disclosed is a high pressure proppant blending system for a compressed gas fracturing system, such as a CO2 fracturing system, that overcomes or mitigates at least one of the shortcomings described above.

In an embodiment, a system for high pressure proppant blending includes at least one high pressure pump coupled to a high pressure flow path, the high pressure flow path entering a wellhead. The system further includes a chamber storing a mixture of bulk proppant and compressed gas. The system also includes a high pressure nozzle. An output of the high pressure nozzle is coupled to the high pressure flow path between the at least one high pressure pump and the wellhead. The chamber is coupled to an input of the high pressure nozzle.

In an embodiment, the system further includes a storage chamber coupled to the at least one high pressure pump via a low pressure flow path. The at least one high pressure pump may be configured to receive compressed gas from storage chamber via the low pressure flow path and to pump the compressed gas into the high pressure flow path. The system may also include a boost pump coupled to the storage chamber. The storage chamber may be coupled to the low pressure flow path via the boost pump.

In an embodiment, a pressure within the low pressure flow path is less than 1,000 pounds per square inch (PSI). A pressure within the low pressure flow path may be between zero and 200 PSI. A pressure within the high pressure flow path may be between 1,000 and 5,000 PSI.

In an embodiment, the system includes a second high pressure flow path branching from the high pressure flow path. The chamber may receive compressed gas from the at least one high pressure pump via the second high pressure flow path. The system may further include a third high pressure flow path. The chamber may be coupled to an input of the nozzle via the third high pressure flow path.

In an embodiment, the system includes a second high pressure pump coupled to the high pressure nozzle via a second high pressure flow path. The chamber may be coupled to the input of the high pressure nozzle via a low pressure flow path, via the second high pressure pump, and via the second high pressure flow path. The system may further include a second low pressure flow path, the second low pressure flow path between the storage chamber and the chamber. The system may also include a boost pump coupled to the chamber. The chamber may be coupled to the second high pressure pump via the boost pump and via the low pressure flow path. The second high pressure pump may be configured to receive a mixture of proppant and compressed gas from the chamber and to pump the mixture of proppant and compressed gas into the second high pressure flow path.

In an embodiment, the system includes a feedback meter coupled to the high pressure flow path between the high pressure nozzle and the wellhead. The feedback meter may be coupled to the high pressure nozzle via a proportional-integral-derivative (PID) loop. The feedback meter may include a densimeter, a flowmeter, or a combination thereof.

In an embodiment, a method for high pressure proppant blending includes receiving, at a high pressure nozzle, a mixture of proppant and compressed gas from a chamber. The method also includes introducing the mixture of proppant and compressed gas into a high pressure flow path between at least one high pressure pump and a wellhead. The method further includes receiving compressed gas at the at least one high pressure pump from a storage chamber via a low pressure flow path. The method includes pumping the compressed gas into the high pressure flow path.

In an embodiment, the method may further include receiving compressed gas at the chamber from a second high pressure flow path branching from the high pressure flow path. The method may also include forming the mixture of proppant and compressed gas by mixing the compressed gas with proppant. The method may include receiving compressed gas at the chamber from the storage chamber via a low pressure flow path. The method may also include forming the mixture of proppant and compressed gas by mixing the compressed gas with proppant. Introducing the mixture of proppant and compressed gas into the high pressure flow path may include receiving the mixture of proppant and compressed gas at a second high pressure pump from the proppant chamber via a low pressure flow path. Introducing the mixture of proppant and compressed gas into the high pressure flow path may also include pumping the mixture of proppant and compressed gas into an input of the high pressure nozzle via a second high pressure flow path.

In an embodiment, the method includes receiving, at a controller, data from a feedback meter via a proportional-integral-derivative (PID) loop. The data may indicate an amount of proppant flow through the high pressure flow path. The method may further include modifying an amount of proppant introduced into the high pressure flow path, based on the data. Modifying an amount of proppant introduced into the high pressure flow path may include initiating, at the controller, a change in a ratio of compressed gas to proppant in the mixture of proppant and compressed gas within the proppant chamber. Modifying an amount of proppant introduced into the high pressure flow path may include initiating, at the controller, adjustment of the high pressure nozzle to modify an amount of the mixture of proppant and compressed gas that flows through the high pressure nozzle. Modifying an amount of proppant introduced into the high pressure flow path may include initiating, at the controller, adjustment of a high pressure pump to modify an amount of the mixture of proppant and compressed gas that is pumped into the high pressure nozzle.

Figure 1:
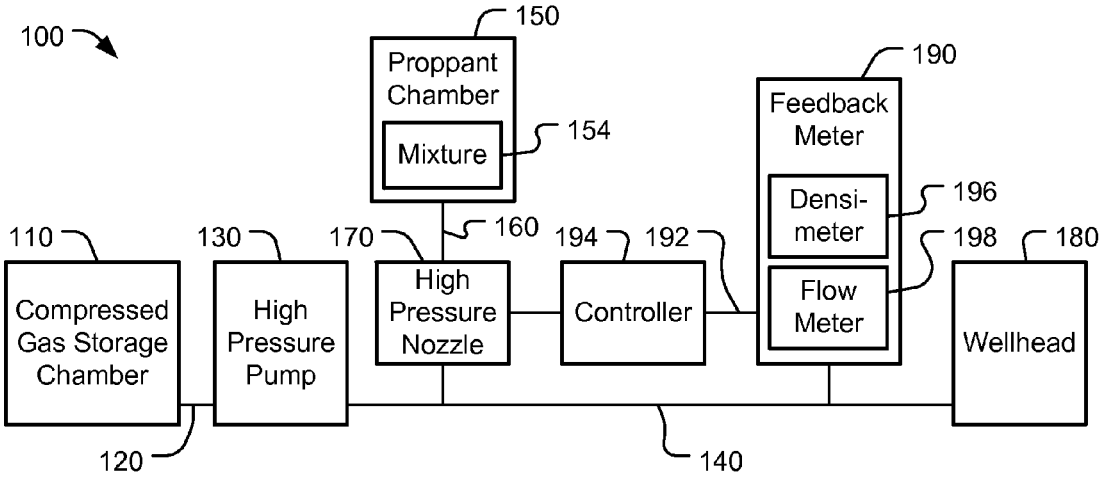
FIG. 1 is a block diagram that illustrates an embodiment of a system for high pressure proppant blending for a compressed gas fracturing system.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

Referring to FIG. 1, an embodiment of a system for high pressure proppant blending for a compressed gas fracturing system is depicted and generally designated 100. The system 100 may include a compressed gas storage chamber 110, a high pressure pump 130, a proppant chamber 150, a high pressure nozzle 170, a well head 180, and a feedback meter 190. Although FIG. 1 depicts the system 100 as including one high pressure pump 130, this is for purposes of illustration only. In other embodiments the system 100 may include multiple high pressure pumps as described herein.

The compressed gas storage chamber 110 may include any chamber capable of storing pressurized and/or liquefied compressed gas. For example, in some embodiments, the compressed gas storage chamber may store liquid carbon dioxide (CO2). A lower pressure flow path 120 may couple the compressed gas storage chamber 110 to the high pressure pump 130. As used herein, low pressure may include pressures that are less than approximately 1,000 lbs. per square inch (PSI). In an embodiment, the pressure within the low pressure flow path 120 may be between 0 and 200 PSI.

The high pressure pump 130 may include a fracturing pump. The fracturing pump may include any triplex pump or quintaplex pump usable for high pressure compressed gas fracturing. The high pressure pump 130 may be configured to receive compressed gas from the compressed gas storage chamber 110 via the low pressure flow path 120. The high pressure pump 130 may be further configured to pump the compressed gas into a high pressure flow path 140. The high pressure flow path 140 may enter the well head 180. Hence, the high pressure pump 130 may pump compressed gas into the well head 180 via the high pressure flow path 140. As used herein, a high pressure may include pressures that are greater or equal to approximately 1,000 PSI. In an embodiment, a pressure within the high pressure flow path 140 may be between approximately 1,000 and approximately 5,000 PSI.

The proppant chamber 150 may generate and/or store a mixture 154 of proppant and compressed gas. Hence, the proppant chamber 150 may include any type of chamber capable of storing and/or mixing proppant and compressed gas. For example, the proppant chamber 150 may include an auger capable of mixing proppant with compressed gas within a pressurized environment. As another example, the proppant chamber 150 may use a fluidized bed approach to mix the proppant with the compressed gas. In some embodiments, the mixture 154 of proppant and compressed gas may include a mixture of proppant and a liquefied gas, such as liquid CO2. The proppant chamber 150 may be coupled to the high pressure nozzle 170 via a flow path 160. The flow path 160 may include one or more systems or devices capable of delivering the mixture 154 of proppant and compressed gas from the proppant chamber 150 to the high pressure nozzle 170, as described herein.

The high pressure nozzle 170 may include any type of high pressure nozzle capable of introducing the mixture 154 of proppant and compressed gas into the high pressure flow path 140. In an embodiment, the high pressure nozzle 170 is resistive to an erosive effect of the proppant. An output of the high pressure nozzle 170 may be coupled to the high pressure flow path 140 between the high pressure pump 130 and the well head 180. Further, in an embodiment the high pressure nozzle 170 is adjustable to control an amount of proppant being introduced into the high pressure nozzle 140, as described herein.

The feedback meter 190 may be coupled to the high pressure flow path 140 and may be configured to determine an amount of proppant within the high pressure flow path 140. For example, the feedback meter 190 may include a densimeter 196, a flow meter 198, another type of feedback meter capable of determining an amount of proppant within the high pressure flow path 140, or any combination thereof. The feedback meter 190 may be coupled to the high pressure nozzle 170 via a proportional-integral-derivative (PID) loop 192. The PID loop 192 may be configured to receive data indicating an amount of proppant within the high pressure flow path 140 and may be further configured to adjust the high pressure nozzle 170 to modify the amount of proppant within the high pressure flow path 140. For example, the PID loop 192 may include a controller 194 configured to selectively adjust an amount of the mixture 154 of proppant and compressed gas that passes through the nozzle 170. In some embodiments, the PID loop 192 may be configured to adjust one or more additional portions of the system 100 such as the flow path 160 and/or the proppant chamber 150. Hence, based on the measurement of proppant within the high pressure flow path indicated to the PID loop 192 a ratio of compressed gas to proppant within the high pressure flow path 140 may be adjusted.

During operation, the high pressure pump 130 may receive compressed gas from the compressed gas storage chamber 110 via the low pressure flow path 120. The high pressure pump 130 may pump and/or otherwise pressurize the compressed gas into the high pressure flow path 140. The high pressure nozzle 170 may receive the mixture 154 of proppant and compressed gas from the proppant chamber 150 via the flow path 160. The high pressure nozzle 170 may pump the mixture 154 of proppant and compressed gas into the high pressure flow path 140 between the high pressure pump 130 and the well head 180. Thereafter, the feedback meter 190 may determine a ratio of proppant to compressed gas within the high pressure flow path 140 and the PID loop 192 may initiate adjustment of the ratio of proppant to compressed gas by initiating adjustment of the high pressure nozzle 170 or another portion of the system 100.

A benefit associated with the system 100 includes introducing proppant into the high pressure flow path 140 without the proppant passing through the high pressure pump 130, thereby causing less wear (due to the erosive nature of the proppant) to the high pressure pump 130. For example, the compressed gas received at the high pressure pump 130 may have a lesser erosive effect than the mixture 154 of proppant and compressed gas stored at the proppant chamber 150. Other advantages and benefits of the system 100 will be apparent to persons of ordinary skill in the relevant art having the benefit of this disclosure.

Figure 2:
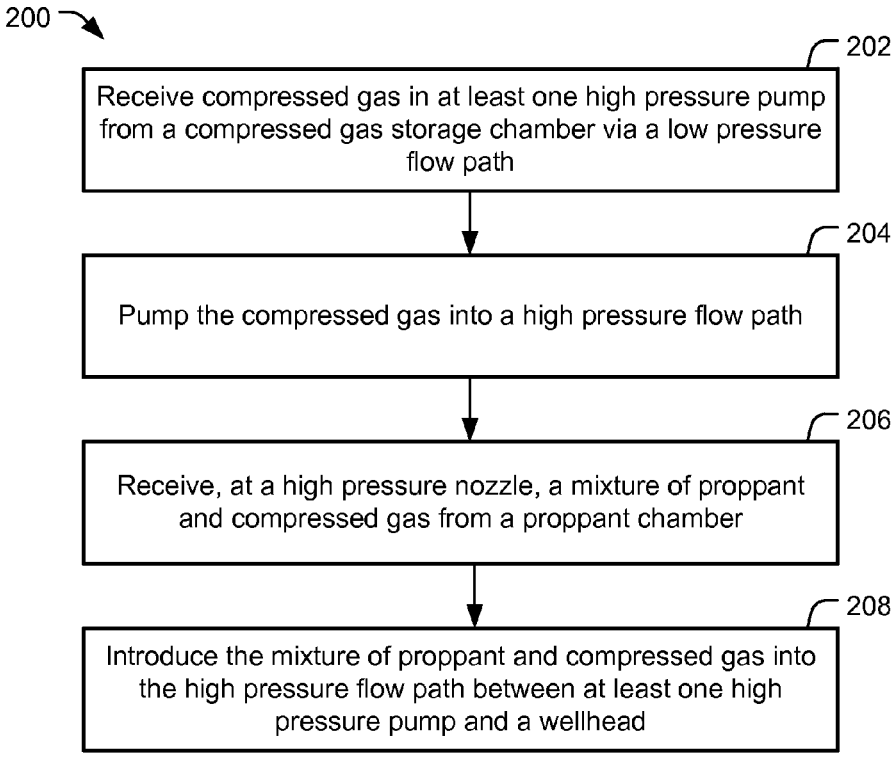
FIG. 2 is a flow diagram that illustrates an embodiment of a method for high pressure proppant blending.

Referring to FIG. 2, an embodiment of a method for high pressure proppant blending is depicted and generally designated 200. The method 200 may include receiving compressed gas in at least one high pressure pump from a compressed gas storage chamber via a low pressure flow path, at 202. For example, the high pressure pump 130 may receive compressed gas from the compressed gas chamber 110 via the low pressure flow path 120. In some embodiments, the compressed gas may include a liquefied gas, such as liquid CO2.

The method 200 may further include pumping the compressed gas into a high pressure flow path, at 204. For example, the high pressure pump 130 may pump the compressed gas into the high pressure flow path 140.

The method 200 may also include receiving, at a high pressure nozzle, a mixture of proppant and compressed gas from a proppant chamber, at 206. For example the high pressure nozzle on 170 may receive the mixture 154 of proppant and compressed gas from the proppant chamber 150.

The method 200 may include introducing the mixture of proppant and compressed gas into the high pressure flow path between at least one high pressure pump and a well head, at 208. For example the high pressure nozzle 170 may introduce the mixture 154 of proppant and compressed gas into the high pressure flow path 140 between the high pressure pump 130 and the well head 180.

A benefit associated with the method 200 is that the bulk proppant stored at the proppant chamber 150 may bypass the high pressure pump 130, thereby preventing wear at the high pressure pump 130 due to the erosive nature of the proppant. Other advantages and benefits of the method 200 will be apparent to persons of ordinary skill in the relevant art having the benefit of this disclosure.

Figure 3:
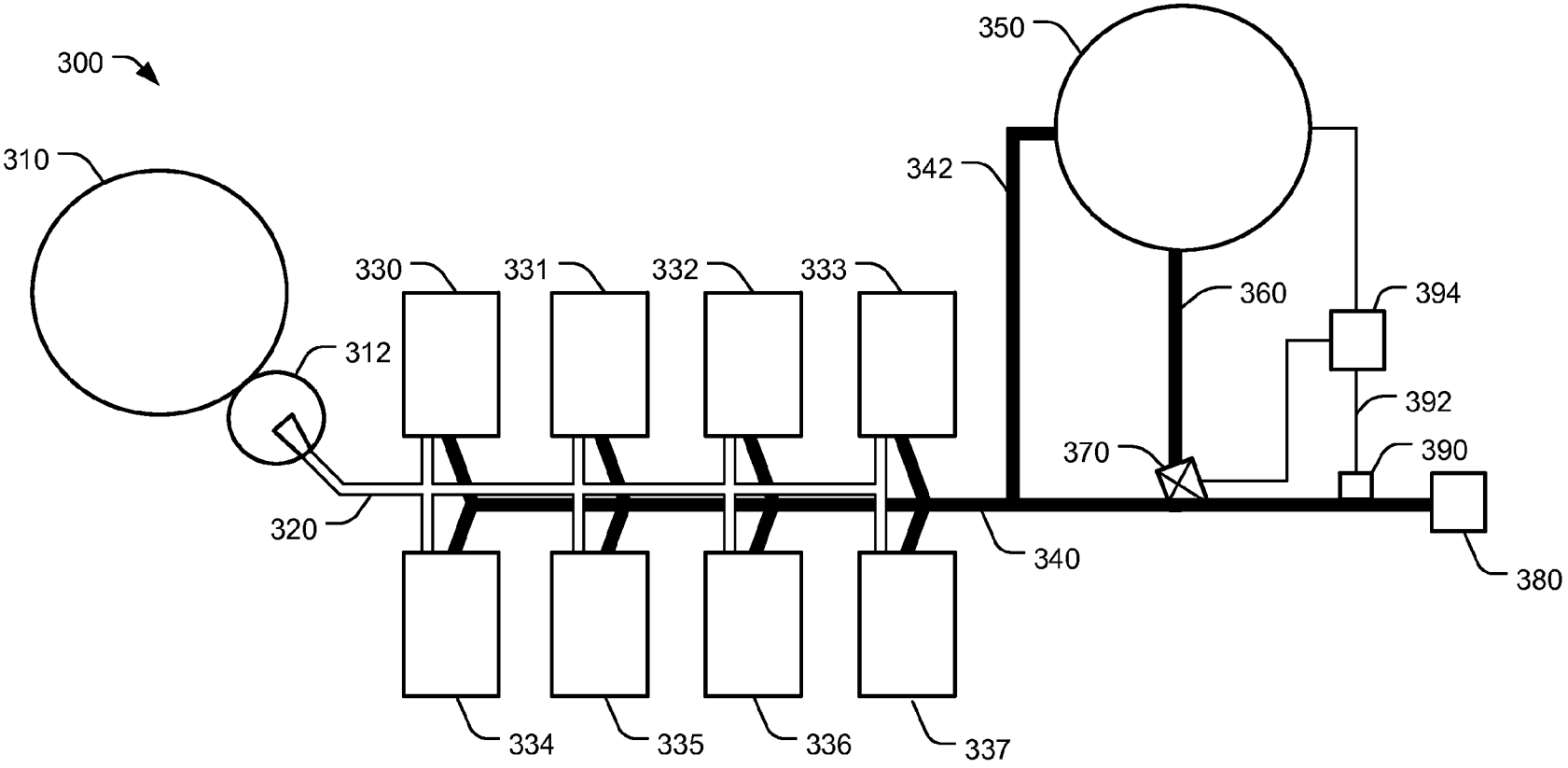
FIG. 3 is a diagram that illustrates an embodiment of a system for high pressure proppant blending for a compressed gas fracturing system.

Referring to FIG. 3, a system for high pressure proppant blending is depicted and generally designated 300. The system 300 may include a compressed gas storage chamber 310, a boost pump 312, multiple high pressure pumps 330-337, a proppant chamber 350, a high pressure nozzle 370, a well head 380, and a feedback sensor 390.

The boost pump 312 may include any type of pump used to build pressure in order to move the compressed gas from the compressed gas storage chamber 310 to a low pressure flow path 320. In some embodiments, the compressed gas may include a liquefied gas, such as liquid CO2. FIG. 3 depicts the low pressure flow path 320 as an outlined path to indicate low pressure, while high pressure flow paths are depicted as solid black paths.

The pressure high pumps 330-337 may be configured to receive compressed gas from the compressed gas storage chamber 310 via the boost pump 312 and via the low pressure flow path 320. The high pressure pumps 330-337 may pump and/or pressurize the compressed gas into the high pressure flow path 340.

In an embodiment, the system 300 may include a second high pressure flow path 342 branching from the first high pressure flow path 340. The second high pressure flow path 342 may connect the first high pressure flow path 340 to the proppant chamber 350. As such, the second high pressure flow path 342 may deliver compressed gas under high pressure to the proppant chamber 350.

The proppant chamber 350 may be configured to mix proppant with compressed gas received via the second high pressure flow path 342. As such, the contents of the proppant chamber 350 (e.g., the bulk proppant and compressed gas) may be under high pressure. The proppant chamber 350 may use a fluidized bed approach under high pressure to mix the proppant with the compressed gas. Alternatively or in addition, the proppant chamber may include an auger to mix the bulk proppant with the compressed gas. The proppant chamber 350 may further be coupled to the high pressure nozzle 370 via a third high pressure flow path 360 and may introduce the mixture of proppant and compressed gas into the third high pressure flow path 360.

The high pressure nozzle 370 may be configured to receive the mixture of proppant and compressed gas from the third high pressure flow path 360 and to introduce the mixture of proppant and compressed gas from the third high pressure flow path 360 into the first high pressure flow path 340 between the high pressure pumps 330-337 and the well head 380.

During operation the high pressure pumps 330-337 may receive compressed gas from the compressed gas storage chamber 310. The high pressure pumps 330-337 may pump the compressed gas into the first high pressure flow path 340. The proppant chamber 350 may receive the compressed gas from the first high pressure flow path 340 via the second high pressure flow path 342. The proppant chamber 350 may mix the compressed gas with proppant to form a mixture of proppant and compressed gas. The mixture of proppant and compressed gas may be directed into the third high pressure flow path 360 and received at the high pressure nozzle 370. The high pressure nozzle 370 may introduce the mixture of proppant and compressed gas into the first high pressure flow path 340 between the high pressure pumps 330-337 and the well head 380.

The feedback meter 390 may measure an amount of proppant within the first high pressure flow path 340. The measurement may be received at a PID loop 392. Based on the measurement, an amount of proppant introduced into the high pressure flow path 340 may be modified. For example, a controller 394 of the PID loop 392 may initiate adjustment of the high pressure nozzle 370 to modify an amount of the mixture of proppant and compressed gas that flows through the high pressure nozzle 370. In some embodiments, the controller 394 may initiate a change in a ratio of liquid carbon dioxide to proppant in the mixture of proppant and compressed gas within the proppant chamber 350 and/or at some other portion of the third high pressure path 360.

A benefit associated with the system 300 is that the mixture of proppant and compressed gas stored in the proppant chamber 350 may be introduced into the flow path 340 without the mixture of proppant and compressed gas passing through the high pressure pumps 330-337. Therefore, the high pressure pumps 330-337 may be subject to less wear due to the erosive effect of the proppant. Although FIG. 3 depicts the system 300 as including eight high pressure pumps, in other embodiments the system 300 may include more than or fewer than eight high pressure pumps.

Figure 4:
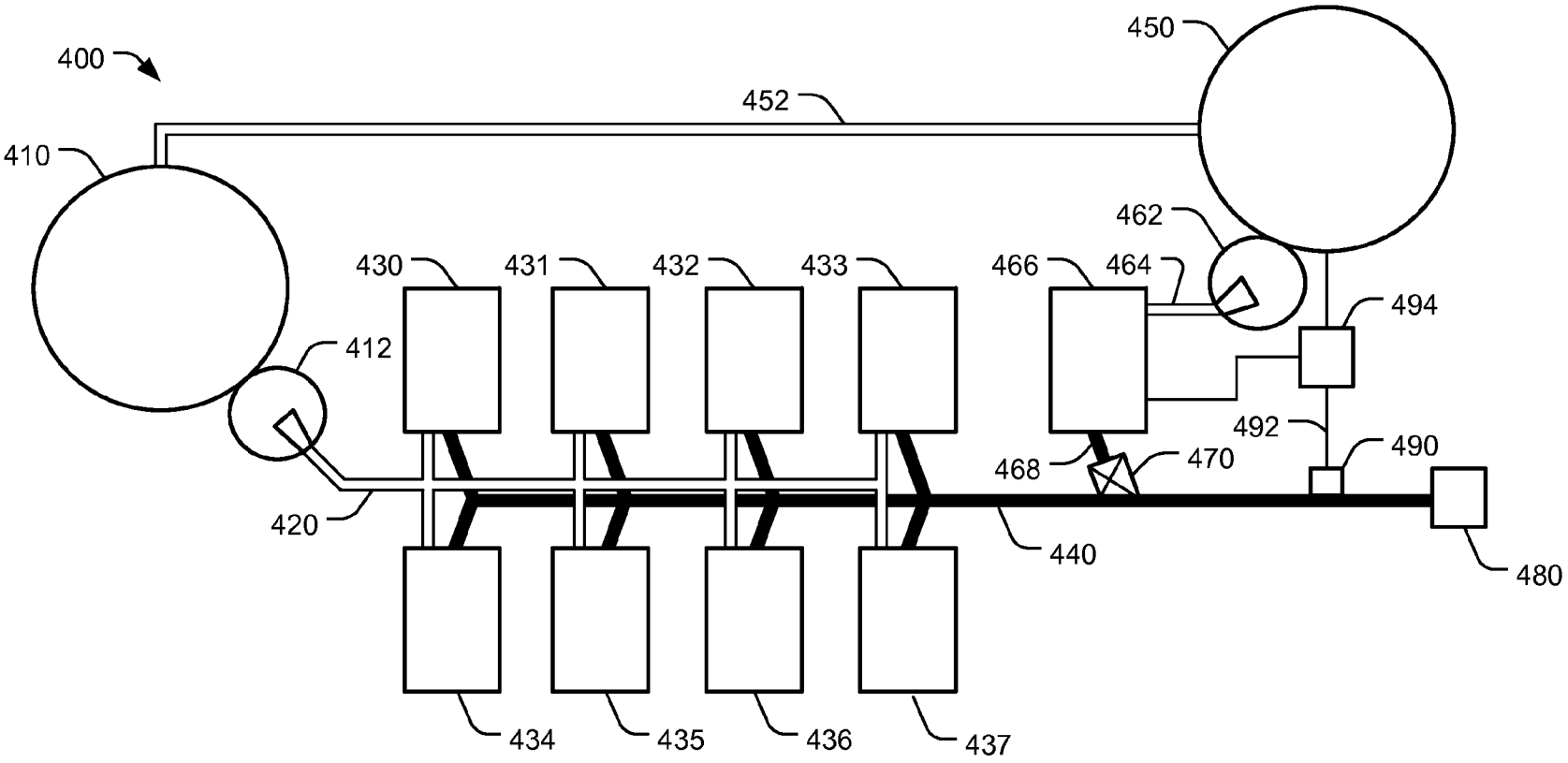
FIG. 4 is a diagram that illustrates an embodiment of a system for high pressure proppant blending for a compressed gas fracturing system.

Referring to FIG. 4, an embodiment of a system for high pressure proppant blending is depicted and generally designated 400. The system 400 may include a compressed gas storage chamber 410, a boost pump 412, multiple high pressure pumps 430-437, a proppant storage chamber 450, a boost pump 462, a high pressure pump 466, a high pressure nozzle 470, a well head 480, and a feedback meter 490.

The high pressure pumps 430-437 may be coupled to the compressed gas storage chamber 410 via the boost pump 412 and via the low pressure flow path 420. As depicted in FIG. 4, in some embodiments the proppant chamber 450 may be coupled to the compressed gas chamber 410 via a second low pressure flow path 452. The proppant chamber 450 may also be coupled to the second high pressure pump 466 via the second boost pump 462 and via a third low pressure flow path 464. The second high pressure pump 466 may be coupled to the high pressure nozzle 470 via a second high pressure flow path 468.

The first boost pump 412 may include any type of boost pump capable of pumping compressed gas to the high pressure pumps 430-437. For example, the first boost pump 412 may include a centrifugal pump, another type of pump, or a combination thereof. In an embodiment, the second boost pump 462 may include a centrifugal pump or another type of pump capable of pumping a mixture of proppant and compressed gas to the high pressure pump 466. Alternatively, the second boost pump 462 may include a posimetric pump configured to feed solid material including proppant into the low pressure path 464.

During operation the proppant chamber 450 may receive compressed gas from the compressed gas storage chamber 410 via the second low pressure flow path 452. In some embodiments, the compressed gas may include a liquefied gas, such as liquid CO2. The proppant chamber 450 may mix bulk proppant with the compressed gas. In an embodiment, the contents of the proppant chamber 450 are under low pressure. The proppant chamber 450 may use a fluidized bed approach, an auger, or a combination thereof to mix the proppant with the compressed gas.

The proppant chamber 450 may direct the mixture of proppant and compressed gas into the second boost pump 462. The second boost pump 462 may pump the mixture of proppant and compressed gas into the second high pressure pump 466 via the third low pressure flow path 464. After receiving the mixture of proppant and compressed gas at the second high pressure pump 466, the mixture of proppant and compressed gas may be pressurized and pumped into the high pressure nozzle 470 via the second high pressure flow path 468. The high pressure nozzle 470 may receive the mixture of proppant and compressed gas from the second high pressure flow path 468 and may introduce the mixture of proppant and compressed gas into the first high pressure flow path 440 between the high pressure pumps 430-437 and the well head 480.

The feedback meter 490 may determine an amount of proppant within the high pressure flow path 440. A PID loop 492 may receive data from the feedback meter 490, the data indicating an amount of proppant flowing through the high pressure flow path 440. Based on the data, an amount of proppant introduced into the high pressure flow path 440 may be modified. For example, a controller 494 of the PID loop 492 may initiate a change in a ratio of liquid carbon dioxide to proppant in the mixture of proppant and compressed gas within the proppant chamber 450. As another example, the controller 494 may initiate adjustment of the high pressure nozzle 470 to modify an amount of the mixture of proppant and compressed gas that flows through the high pressure nozzle 470. As another example, the controller 494 may initiate adjustment of the second high pressure pump 466 to modify an amount of the mixture of proppant and compressed gas that is pumped into the high pressure nozzle 470.

A benefit associated with the system 400 is that the mixture of proppant and compressed gas may be introduced into the high pressure flow path 440 between the high pressure pumps 430-437 and the well head 480, thereby bypassing the high pressure pumps 430-437. Hence, the second high pressure pump 466 may be subjected to the erosive effects of the proppant instead of each of the high pressure pumps 430-437. Other advantages and benefits of the system 400 will be apparent to persons of ordinary skill in the relevant art having the benefit of this disclosure.

Although various embodiments have been shown and described, the present disclosure is not so limited and will be understood to include all such modifications and variations are would be apparent to one skilled in the art.

What is claimed is:

1. A system for high pressure proppant blending comprising:

at least one high pressure pump coupled to a high pressure flow path, the high pressure flow path entering a wellhead;

a chamber storing a mixture of proppant and compressed gas;

a high pressure nozzle, an output of the high pressure nozzle coupled to the high pressure flow path between the at least one high pressure pump and the wellhead, the chamber coupled to an input of the high pressure nozzle.

2. The system of claim 1, wherein the high pressure nozzle is configured to introduce the mixture of proppant and compressed gas from the chamber into the high pressure flow path.

3. The system of claim 1, further comprising:

a storage chamber coupled to the at least one high pressure pump via a low pressure flow path, the at least one high pressure pump configured to receive compressed gas from storage chamber via the low pressure flow path and to pump the compressed gas into the high pressure flow path.

4. The system of claim 3, further comprising:

a boost pump coupled to the storage chamber, the storage chamber coupled to the low pressure flow path via the boost pump.

5. The system of claim 3, wherein a pressure within the low pressure flow path is between zero and 1,000 pounds per square inch (PSI).

6. The system of claim 3, wherein a pressure within the low pressure flow path is between zero and 200 PSI.

7. The system of claim 1, wherein a pressure within the high pressure flow path is between 1,000 and 5,000 PSI.

8. The system of claim 1, further comprising:

a second high pressure flow path branching from the high pressure flow path, wherein the chamber receives compressed gas from the at least one high pressure pump via the second high pressure flow path.

9. The system of claim 8, further comprising:

a third high pressure flow path, wherein the chamber is coupled to an input of the nozzle via the third high pressure flow path.

10. The system of claim 1, further comprising:

a second high pressure pump coupled to the high pressure nozzle via a second high pressure flow path, the chamber coupled to the input of the high pressure nozzle via a low pressure flow path, via the second high pressure pump, and via the second high pressure flow path.

11. The system of claim 10, further comprising:

a second low pressure flow path, the second low pressure flow path between the storage chamber and the chamber.

12. The system of claim 10, further comprising:

a boost pump coupled to the chamber, the chamber coupled to the second high pressure pump via the boost pump and via the low pressure flow path.

13. The system of claim 12, wherein the boost pump includes a posimetric pump.

14. The system of claim 10, wherein the second high pressure pump is configured to receive a mixture of proppant and compressed gas from the chamber and to pump the mixture of proppant and compressed gas into the second high pressure flow path.

15. The system of claim 1, further comprising:

a feedback meter coupled to the high pressure flow path between the high pressure nozzle and the wellhead, the feedback meter coupled to the high pressure nozzle via a proportional-integral-derivative (PID) loop.

16. The system of claim 15, wherein the feedback meter comprises a densimeter, a flowmeter, or a combination thereof.

17. The system of claim 1, wherein the compressed gas comprises liquid carbon dioxide.

18. The system of claim 1, wherein the at least one high pressure pump further comprises a fracturing pump.

19. A method for high pressure proppant blending comprising:

receiving, at a high pressure nozzle, a mixture of proppant and compressed gas from a chamber;

introducing the mixture of proppant and compressed gas into a high pressure flow path between at least one high pressure pump and a wellhead.

20. The method of claim 19, further comprising:

receiving compressed gas at the at least one high pressure pump from a storage chamber via a low pressure flow path; and pumping the compressed gas into the high pressure flow path.

21. The method of claim 19, further comprising:

receiving compressed gas at the chamber from a second high pressure flow path branching from the high pressure flow path; and forming the mixture of proppant and compressed gas by mixing the compressed gas with proppant.

22. The method of claim 19, further comprising:

receiving compressed gas at the chamber from the storage chamber via a low pressure flow path; and forming the mixture of proppant and compressed gas by mixing the compressed gas with proppant.

23. The method of claim 19, wherein introducing the mixture of proppant and compressed gas into the high pressure flow path comprising:

receiving the mixture of proppant and compressed gas at a second high pressure pump from the proppant chamber via a low pressure flow path; and pumping the mixture of proppant and compressed gas into an input of the high pressure nozzle via a second high pressure flow path.

24. The method of claim 19, further comprising:

receiving, at a controller, data from a feedback meter via a proportional-integral-derivative (PID) loop, the data indicating an amount of proppant flow through the high pressure flow path; and modifying an amount of proppant introduced into the high pressure flow path, based on the data.

25. The method of claim 24, wherein modifying an amount of proppant introduced into the high pressure flow path comprises:

initiating, at the controller, a change in a ratio of compressed gas to proppant in the mixture of proppant and compressed gas within the proppant chamber.

26. The method of claim 24, wherein modifying an amount of proppant introduced into the high pressure flow path comprises:

initiating, at the controller, adjustment of the high pressure nozzle to modify an amount of the mixture of proppant and compressed gas that flows through the high pressure nozzle.

27. The method of claim 24, wherein modifying an amount of proppant introduced into the high pressure flow path comprises:

initiating, at the controller, adjustment of a high pressure pump to modify an amount of the mixture of proppant and compressed gas that is pumped into the high pressure nozzle.

28. The method of claim 19, wherein the at least one high pressure pump further comprises a fracturing pump.

* * * * *